US011828021B2

(12) United States Patent
Kueckmann et al.

(10) Patent No.: US 11,828,021 B2
(45) Date of Patent: Nov. 28, 2023

(54) METHOD AND DEVICE FOR THE PRODUCTION AND/OR PROCESSING OF A NONWOVEN GLASS FABRIC WEB

(71) Applicant: VOITH PATENT GMBH, Heidenheim (DE)

(72) Inventors: Philipp Kueckmann, Schwalmtal (DE); Franziska Ferrer, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 534 days.

(21) Appl. No.: 16/914,992

(22) Filed: Jun. 29, 2020

(65) Prior Publication Data

US 2020/0407909 A1 Dec. 31, 2020

(30) Foreign Application Priority Data

Jun. 27, 2019 (DE) ..... 102019117281

(51) Int. Cl.

| | |
|---|---|
| ***D06M 10/00*** | (2006.01) |
| ***D04H 1/4226*** | (2012.01) |
| ***D04H 1/655*** | (2012.01) |
| ***D04H 3/004*** | (2012.01) |

(52) U.S. Cl.

CPC ..... *D06M 10/001* (2013.01); *D04H 1/4226* (2013.01); *D04H 1/655* (2013.01); *D04H 3/004* (2013.01); *D10B 2101/06* (2013.01)

(58) Field of Classification Search

CPC ..... D04H 1/4226; D04H 1/655; D04H 3/004; D04H 1/58; D06M 10/001; D10B 2101/06; F26B 13/104; F26B 3/04; F26B 3/30

See application file for complete search history.

(56) References Cited

U.S. PATENT DOCUMENTS

| | | | | |
|---|---|---|---|---|
| 3,937,865 | A | 2/1976 | Jongetjes | |
| 4,882,852 | A * | 11/1989 | Kautto | F26B 13/10 34/68 |
| 2009/0007452 | A1* | 1/2009 | Cho | F26B 3/30 34/265 |
| 2009/0075541 | A1* | 3/2009 | Zheng | D04H 1/587 427/372.2 |
| 2010/0143684 | A1 | 6/2010 | Geel et al. | |
| 2019/0276960 | A1 | 9/2019 | Paniagua et al. | |

FOREIGN PATENT DOCUMENTS

| | | | |
|---|---|---|---|
| DE | 2155764 | A1 | 5/1972 |
| DE | 102016120933 | A1 | 5/2018 |
| EP | 3115399 | A1 | 1/2017 |

* cited by examiner

*Primary Examiner* — Lynda Salvatore

(74) *Attorney, Agent, or Firm* — Laurence A. Greenberg; Werner H. Stemer; Ralph E. Locher

(57) ABSTRACT

A method for producing and/or processing a nonwoven glass fabric web includes thermally drying the nonwoven glass fabric web via infrared radiation from an infrared radiation dryer. A specific power density of at least 153 kW/m$^2$ is applied by the infrared radiation dryer to the surface of the nonwoven glass fabric web facing toward the infrared radiation dryer. After the irradiation by the infrared radiation dryer, the nonwoven glass fabric web has a temperature of at least 40° C. and at most 105° C. on its surface facing toward the infrared radiation dryer.

8 Claims, 1 Drawing Sheet

METHOD AND DEVICE FOR THE PRODUCTION AND/OR PROCESSING OF A NONWOVEN GLASS FABRIC WEB

CROSS-REFERENCE TO RELATED APPLICATION

This application claims the priority, under 35 U.S.C. § 119, of German application DE 10 2019 117 281, filed Jun. 27, 2019; the prior application is herewith incorporated by reference in its entirety.

BACKGROUND OF THE INVENTION

Field of the Invention

The present invention relates to a method for the production and/or processing of a nonwoven glass fabric web. The method includes the following step: thermal drying of a nonwoven glass fabric web by means of infrared radiation from an infrared radiation dryer. The present invention furthermore also relates to a corresponding device for carrying out the method.

In the processing of nonwoven glass fabrics, a coat is often applied thereon, in a similar way as is known when coating paper. In general, the subsequent drying of the coat is carried out by means of conventional air dryers, which function according to the impingement principle. However, since nonwoven glass fabrics have a high porosity, unlike paper, the blowing air can only be blown onto the nonwoven glass fabric surface coated with a low flow speed in order to avoid "blowing away" the coat. This consequently leads to low heat transfer coefficients and a low energy input. For the coat, this means slower immobilization.

The same applies for the production of nonwoven glass fabrics. The binder applied during production may likewise be "blown away" by excessively high air speeds, which leads to limitation of the specific energy input and therefore to slow immobilization, or delayed solidification of the nonwoven glass fabric.

In published, non-prosecuted German patent application DE 10 2016 120 933 A1 in the name of the Applicant, it has already been proposed to carry out the drying of the binder or coat for nonwoven glass fabrics at least partially by means of infrared radiation by means of an infrared radiation dryer. In this way, the risk of "blowing away" is reduced and immobilization of the coat, or solidification of the nonwoven glass fabric, may be carried out more rapidly.

A disadvantage with this known method is however that, as before, the immobilization of the coat, or the solidification of the nonwoven glass fabric, requires a certain time, which has a negative effect on the production quantity per unit time.

BRIEF SUMMARY OF THE INVENTION

It is an object of the present invention to at least reduce the aforementioned disadvantage of the prior art.

This object is achieved by the features of the independent claims. The dependent claims relate to advantageous refinements of the invention.

Thus, the invention teaches a method for the production and/or processing of a nonwoven glass fabric web, which method contains the following step: thermal drying of the nonwoven glass fabric web by means of infrared radiation from an infrared radiation dryer, and which in particular is distinguished in that a specific power density of at least 153 $kW/m^2$ is applied by the infrared radiation dryer to the surface of the nonwoven glass fabric web facing toward the infrared radiation dryer, and in that after the irradiation by the infrared radiation dryer, the nonwoven glass fabric web has a temperature of at least 40° C. and at most 105° C. on its surface facing toward the infrared radiation dryer.

The inventors have discovered that nonwoven glass fabrics unexpectedly withstand the application of such a high specific power density, which is at least 153 $kW/m^2$, without damage, so long as it is ensured that the temperature at the surface remains in a moderate range of from 40° C. to 105° C. The high specific power density makes it possible to operate with high process speeds. The temperature at the surface of the nonwoven glass fabric web facing toward the infrared dryer depends crucially on the length of extent of the infrared radiation dryer in the process direction and on the speed with which the nonwoven glass fabric web is moved past the infrared radiation dryer relative to the latter. Both factors have an influence on the time for which a surface section of the nonwoven glass fabric web is exposed to the infrared radiation of the infrared radiation dryer.

If the nonwoven glass fabric web is intended to be processed by applying a coat, this is preferably applied onto the surface of the nonwoven glass fabric web facing toward the infrared radiation dryer immediately before the drying of the nonwoven glass fabric web by infrared radiation from the infrared radiation dryer. In this context, "immediately" means that no other machinery is intended to be provided between the application mechanism and the infrared radiation dryer. The path length between the application mechanism and the infrared radiation dryer may therefore be kept small, and the nonwoven glass fabric web coated with the coat may be guided freely, i.e. without contact, through the infrared radiation dryer. This is advantageous for the quality of the coat application, which must be protected against contact before it is fully dried. A curtain application mechanism is particularly suitable as an application mechanism for the coat.

After the drying of the nonwoven glass fabric web by means of infrared radiation from the infrared radiation dryer, the nonwoven glass fabric web may furthermore be dried by hot air in a hot air dryer. This may be economically advantageous since infrared radiation dryers generally have higher operating costs than hot air dryers. By the infrared radiation dryer, however, rapid immobilization of the coat or of the binder on the nonwoven glass fabric web may be achieved, so that the hot air dryer, which generally works according to the impingement principle, may be used for the subsequent full drying without running the risk of "blowing away" the applied coat or binder.

These two types of dryer may be operated together particularly economically if the infrared radiation dryer and the hot air dryer, which follows in the direction of movement of the nonwoven glass fabric web, are configured as a combination dryer unit. A plurality of such combination dryer units may also be arranged successively. In this case, hot air from the infrared radiation dryer is preferably aspirated and at least partially delivered to the hot air dryer. This makes the process particularly energy-efficient.

It is advantageous for there to be a distance of less than 50 cm, preferably less than 30 cm, between the hot air dryer and the infrared radiation dryer. In this way, it is possible to ensure that the temperature of the surface, irradiated by the infrared radiation dryer, of the nonwoven glass fabric web does not decrease significantly before the nonwoven glass fabric web is guided into the hot air dryer.

A further aspect of the present invention relates to a device for the production and/or processing of a nonwoven glass fabric web, wherein the device contains an infrared radiation dryer for thermal drying of the nonwoven glass fabric web by means of infrared radiation, which is distinguished particularly in that the infrared radiation dryer is configured to apply a specific power density of at least 153 $kW/m^2$ to the surface of the nonwoven glass fabric web facing toward the infrared radiation dryer, and wherein the device is configured in such a way that after the irradiation by the infrared radiation dryer, the nonwoven glass fabric web has a temperature of at least 40° C. and at most 105° C. on its surface facing toward the infrared radiation dryer. Preferably, the device is configured to carry out the method according to the invention as described above.

Other features which are considered as characteristic for the invention are set forth in the appended claims.

Although the invention is illustrated and described herein as embodied in a method for the production and/or processing of a nonwoven glass fabric web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
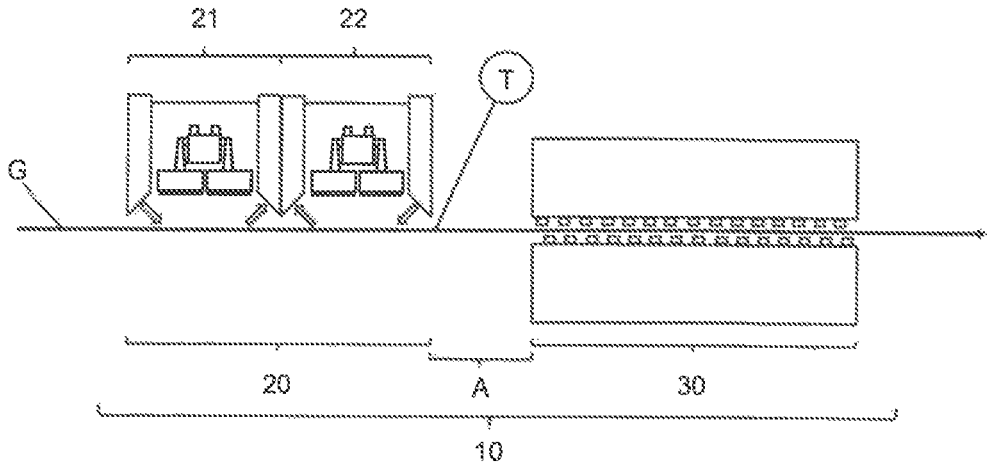
FIG. 1 is a diagrammatic, illustration of a first embodiment of a device according to the invention.

Referring now to the figures of the drawings in detail and first, particularly to FIG. 1 thereof, there is shown a first embodiment of a device according to the invention. In this case, a nonwoven glass fabric web G coated with a binder or a coating is guided through a dryer 10 (from left to right in FIG. 1). The binder or the coating may have been applied immediately before the drying of the nonwoven glass fabric web G onto a surface thereof, for example by a curtain application mechanism (not represented here).

The dryer 10 contains an infrared radiation dryer 20 arranged upstream as seen in the process direction, and a hot air dryer 30 arranged downstream. The distance A between the infrared radiation dryer 20 and the hot air dryer 30 is in this case less than 30 cm. The infrared radiation dryer 20 may itself contains a plurality of modules, of which each module may in turn contain a plurality of rows of individual infrared radiators. In the exemplary embodiment represented here, the infrared radiation dryer contains two modules 21, 22, each of which contains two rows of infrared radiators. Furthermore, each of the two modules 21, 22 also contains a fresh air supply and a used air discharge, the air flows being denoted by arrows in FIG. 1. The dryer in this case extends over the entire width (orthogonally to the plane of the image in FIG. 1) of the nonwoven glass fabric web G to be dried.

According to the invention, a specific power density of at least 153 $kW/m^2$ is applied by the infrared radiation dryer 20 to the surface of the nonwoven glass fabric web G facing toward the infrared radiation dryer. At the same time, by suitable selection of the overall length of the infrared radiation dryer 20 and of the speed with which the nonwoven glass fabric web G is guided through the dryer 10, it is ensured that, after the irradiation by the infrared radiation dryer 20, the nonwoven glass fabric web has a temperature of at least 40° C. and at most 105° C. on its surface facing toward the infrared radiation dryer 20. In order to monitor the surface temperature, a temperature sensor T which is suitable for contactlessly determining the temperature on the surface of the nonwoven glass fabric web at the end of the infrared radiation dryer 20, for example by use of laser technology, may be installed in the dryer 10.

The hot air dryer 30 is configured to blow hot air, which it draws from a source (not represented here), onto the surface to be dried of the nonwoven glass fabric web G. In this case, the drying is carried out primarily by the impingement principle.

Figure 2:
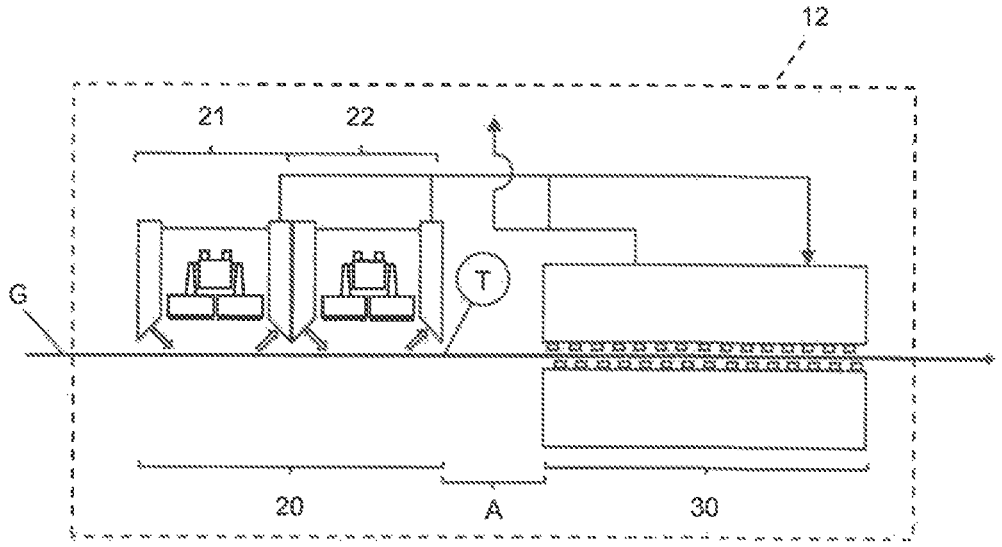
FIG. 2 is a diagrammatic, illustration of a second embodiment of a device according to the invention.

The second exemplary embodiment of a device according to the invention, represented in FIG. 2, differs only slightly from the first exemplary embodiment represented in FIG. 1. Only the differences will therefore be discussed below, and in other regards reference is made to the description above. The main difference is that the dryer in the second exemplary embodiment is configured as a combination dryer unit 12. In this case, warm air from the used air discharge of the two modules 21, 22 of the infrared radiation dryer 20 is at least partially delivered to the hot air dryer 30. This does not mean that the hot air dryer 30 is not connected to a further source of hot air, but that the guiding of hot air from the infrared radiation dryer 20 to the hot air dryer 30 helps to reduce the energy consumption overall. The infrared radiation dryer 20 and the hot air dryer 30 of the combination dryer unit 12 may furthermore contain a common housing.

LIST OF REFERENCES

10 dryer
12 combination dryer unit
20 infrared radiation dryer
21 module
22 module
30 hot air dryer
G nonwoven glass fabric web
T temperature sensor

The invention claimed is:

1. A method for processing a nonwoven glass fabric web, which comprises the steps of:

thermally drying the nonwoven glass fabric web by means of infrared radiation from an infrared radiation dryer, a specific power density of at least 153 $kW/m^2$ is applied by the infrared radiation dryer to a surface of the nonwoven glass fabric web facing toward the infrared radiation dryer, a length of the infrared radiation dryer in the process direction and a speed with which the nonwoven glass fabric web moves past the infrared radiation dryer being selected such that after irradiation by the infrared radiation dryer, the nonwoven glass fabric web has a temperature of at least 40° C. and at most 105° C. on the surface facing toward the infrared radiation dryer.

2. A method for processing a nonwoven glass fabric web, which comprises the steps of:

thermally drying the nonwoven glass fabric web by means of infrared radiation from an infrared radiation dryer, a specific power density of at least 153 $kW/m^2$ is applied by the infrared radiation dryer to a surface of the nonwoven glass fabric web facing toward the infrared radiation dryer, and in that after irradiation by the infrared radiation dryer, the nonwoven glass fabric web has a temperature of at least 40° C. and at most 105° C. on the surface facing toward the infrared radiation dryer; and applying a coating onto the surface of the nonwoven glass fabric web facing toward the infrared radiation dryer immediately before drying of the nonwoven glass fabric web by means of the infrared radiation from the infrared radiation dryer, such that no other machinery is provided that contacts the coated surface of the nonwoven glass fabric web between the coating being applied and the nonwoven glass fabric web entering the infrared dryer.

3. The method according to claim 1, wherein after a drying of the nonwoven glass fabric web by means of the infrared radiation from the infrared radiation dryer, the nonwoven glass fabric web is furthermore dried by hot air in a hot air dryer.

4. The method according to claim 3, wherein the infrared radiation dryer and the hot air dryer, which follows in a direction of movement of the nonwoven glass fabric web, are configured as a combination dryer unit.

5. The method according to claim 4, which further comprises disposing a plurality of combination dryer units successively in the direction of movement of the nonwoven glass fabric web.

6. The method according to claim 3, wherein the hot air from the infrared radiation dryer is aspirated and at least partially delivered to the hot air dryer.

7. The method according to claim 3, wherein there is a distance of less than 50 cm between the hot air dryer and the infrared radiation dryer.

8. The method according to claim 3, wherein there is a distance of less than 30 cm between the hot air dryer and the infrared radiation dryer.

* * * * *